US005593138A

United States Patent [19]

Zaguroli, Jr.

[11] Patent Number: 5,593,138

[45] Date of Patent: Jan. 14, 1997

[54] AIR BALANCING HOIST COMBINATION

[75] Inventor: James Zaguroli, Jr., Drayton Plains, Mich.

[73] Assignee: Knight Industries, Inc., Auburn Hills, Mich.

[21] Appl. No.: 490,202

[22] Filed: Jun. 14, 1995

Related U.S. Application Data

[63] Continuation-in-part of Ser. No. 414,509, Mar. 31, 1995, abandoned.

[51] Int. Cl.[6] ..... B66D 1/10

[52] U.S. Cl. ..... 254/314; 254/288; 254/360

[58] Field of Search ..... 254/288, 314, 254/360

[56] References Cited

U.S. PATENT DOCUMENTS

| | | | |
|---|---|---|---|
| 810,884 | 1/1906 | Pilling | 254/314 |
| 2,710,107 | 6/1955 | Powell | 254/314 |
| 3,428,298 | 2/1969 | Powell | 254/168 |
| 4,061,311 | 12/1977 | Yamasaki et al. | 254/360 |
| 5,370,367 | 12/1994 | Zaguroli, Jr. | 254/360 |
| 5,439,200 | 8/1995 | Braesch et al. | 254/360 |

*Primary Examiner*—Katherine Matecki
*Attorney, Agent, or Firm*—John R. Benefiel

[57] ABSTRACT

A combination of air balancing hoists is described in which two or more hoists are connected end to end each with a load cable connected at spaced locations on the load item to enable raising a bulky load item. Force transmission rods axially interengage axially moving components of the connected hoists to insure that the cables are raised and lowered together to maintain the attitude of the load item as it is raised or lowered.

10 Claims, 5 Drawing Sheets

AIR BALANCING HOIST COMBINATION

CROSS-REFERENCE TO RELATED APPLICATION

This application is a continuation-in-part of U.S. patent application Ser. No. 08/414,509, filed on Mar. 31, 1995, now abandoned.

BACKGROUND OF THE INVENTION

This invention concerns air balancing hoists of the type in which regulated air pressure is used to counter the weight of a suspended load to make it easier to maneuver the load by the hoist operator.

See U.S. Pat. No. 3,428,298 issued on Feb. 18, 1969 for a "Tool Balancer" for an example of such a hoist.

In this type of hoist, fluid pressure chamber is within the hoist housing acting on an axially movable piston, which in turn acts on a ball screw mechanism to cause a torque to be exerted on a cable drum to counteract the weight of a load suspended from a load cable wound on the drum.

An air pressure controller maintains a selectively set regulated pressure in the chamber so that if the load is pulled down, the resulting slightly increased pressure is relieved to allow lowering of the load to a new position. Alternatively, the pressure can be increased or decreased slightly to cause the load to be raised or lowered.

Sometimes bulky loads require additional hoists, with cables connected at spaced locations on the load. In this instance, special efforts must be taken to maintain the load in its desired initial horizontal orientation as it is raised or lowered by the above methods. Where the load weight is inadvertently shifted by tilting, this further complicates the problem as the balancing hoist will pay out or retract cable if the pulling force on its cable changes even slightly.

Accordingly, it is an object of the present invention to provide an arrangement for using two or more air balancing hoists for handling bulky load items which maintains a desired load attitude.

SUMMARY OF THE INVENTION

This object, and others which will become apparent upon reading the following specification and claims are achieved by connecting two or more hoists to effect a combined action. The hoists have their respective housings connected end-to-end. A series of axially directed force transmission rods drivingly interconnect the piston cable drum elements of the respective hoists to insure synchronized movement and closely matched movement of the cables. In a first embodiment, the rods have one end engaging an end of the cable drum of a master hoist opposite to the end engaged by the pressure chamber piston, with the other end of the force transmission rods engaged with the piston driven end of the cable drum of the connected hoist. The two cable drums are thus slaved so that both cable drums move axially together and the winding action of both is identical.

In the first embodiment, the piston and air chamber is entirely omitted in the slaved hoist so that the master hoist piston generates all of the lifting force.

In a second embodiment, the other ends of the rods engage the piston rather than the winding drum directly, and a piston and air chamber are included in the slaved hoist, but the air pressure is set to be in a lower range than that of the master hoist and below that which could by itself result in lifting of its load cable. This allows the slaved hoist piston to exert a force assisting in supporting the weight of the load item, while ensuring that the movement of its cable drum is maintained synchronized to that of the master hoist cable drum.

In a third preferred embodiment, the transmission rods directly engage the pistons of the respective hoists to eliminate any need for thrust bearings.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
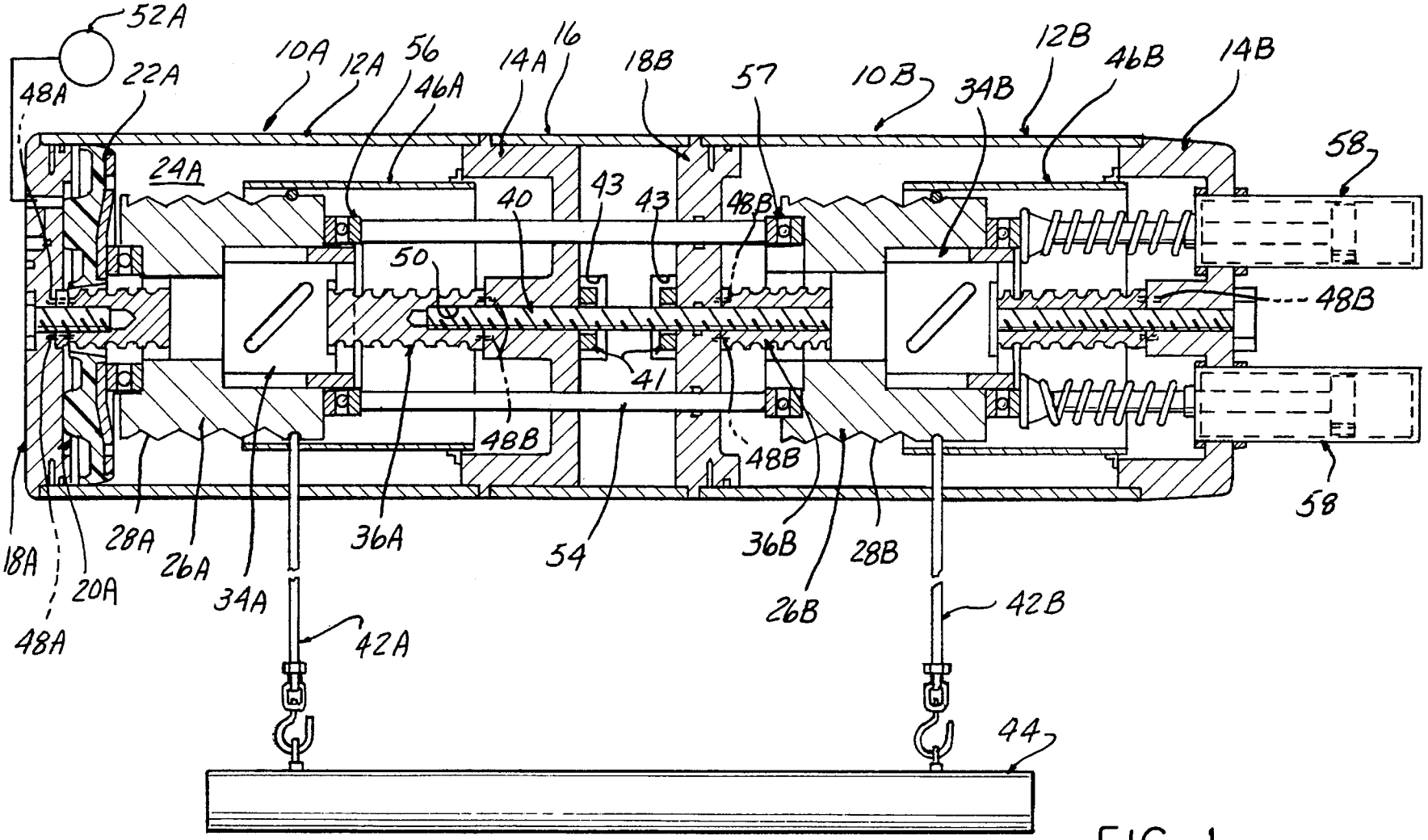
FIG. 1 is a longitudinal sectional view of a pair of hoists connected together by an arrangement according to the present invention, showing an elongated load item supported by respective cables connected at respective spaced locations, and a schematic representation of an air pressure controller.

Referring to FIG. 1, a pair of hoists are shown in section, a "master" hoist 10A and a slave hoist 10B, having their housings 12A, 12B connected together end-to-end. The master hoist 10A includes a hollow cylindrical housing 12A, one end received over and attached to one end of a left end cap 14A, the other end of which receives one end of a spacer housing section 16. Spacer housing section 16 receives right end cap 18B of the slave hoist 10B which also receives one end of the slave hoist hollow cylindrical housing 12B, such that the master hoist 12A and slave hoist 12B are located in an end to end and coaxial relationship.

Master hoist 12A includes a right hand end cap 18A received in housing 12A, and sealed thereto to create a fluid pressure chamber 20A, also defined in part by a piston 22A slidable in the bore 24A defined by the inside of housing 12A. Piston 22A engages one end of a cable drum 26A having an exterior spiral groove 28A adapted to have a load cable 30A wound thereon. An interposed ball bearing 32A reduces friction as the drum 26A is rotated.

The cable drum 26A is fixed to a ball nut 34A in turn supported by a ball screw 36A rotatably fixed at either end within the housing 12A by a bolt 38A and a threaded shaft 40 respectively. Antirotation keys 48A are also provided.

Figure 2:
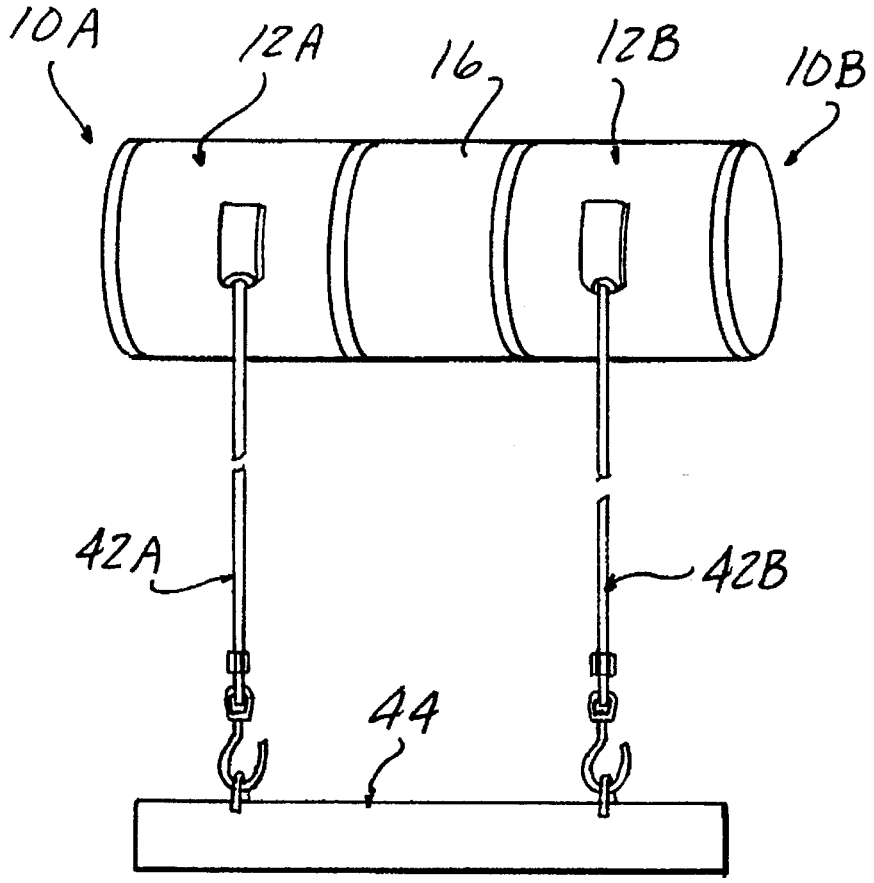
FIG. 2 is a perspective view of the connected hoists and load item shown in FIG. 1.

A load cable 42A is attached at one end to the cable drum 26A and extends out through an opening in the housing 12A, and supports one end of a wide load item 44 as shown in FIGS. 1 and 2.

Air under regulated pressure is introduced into chamber 20A from a controller 52, tending to force the piston 22A to the right causing the cable drum 26A to be shifted axially and thereby rotated by the action of the ball nut 34A and ball screw 36A in the manner well known in the art, winding up the cable 42A and raising the load 44. A confinement sleeve 46A fixed to end cap 14A surrounds the cable drum 26A and wrapped portion of cable 42A to prevent its escape from the groove 28A.

The slave hoist 10B also includes a cable drum 26B having a spiral groove 28B for winding a load cable 42B attached at one end thereto. The cable drum 26B is similarly mounted on a ball nut 34B in turn supported on a ball screw 36B non-rotatably mounted in the housing 12B by threaded shaft 40 and bolt 38B. Cable 42B is fixed at one end to cable drum 26B, the other end passing out of housing 12B and having its other end also supporting the load item 44 at a location spaced from the master hoist cable 42A.

A confinement sleeve 46B is fixed to end cap 14B and serves to prevent the cable 42B from escaping the groove 28B as the cable 42B is wound and unwound.

The assembly is drawn together by the threaded shaft 40 being advanced into a threaded axial bore 50 in the right hand end of ball screw 36A, shaft 40 passing through the ball screw 36B and out through the end cap 14B. Locking nuts 41 secure the threaded shaft 40 in its tightened condition, nuts 41 accessed through slots 42 in the housing 16.

A series of force transmission rods 54 extend axially from the right hand end of the master hoist cable drum 26A opposite the left end engaged by the piston 22A to the left hand end of the slave hoist cable drum 26B. The opposite ends of the force transmission rods 54 engage respective ball bearings 56, 58 mounted in recesses in the right end of cable drum 26A and the left end of cable drum 26B, reducing the friction as the cable drums 26A rotate past the non-rotating ends of the force transmission rods 54. The rods 54 are preferably arranged in symmetrical pairs, each rod in each pair located diametrically opposite from the other to minimize any tipping forces.

The force transmission rods 54 are slidable in bores machined in the aluminum end caps 14A, 18B, these rods preferably commercially available precision ground hardened steel shafting commonly used as ways for linear bearings, and thus can be used without separate bearings in the caps 14A, 14B.

The right end of cable drum 26B is engaged with the actuator rod of sets of damping cylinders 58, to prevent runaway elevation of the cables 42A, 42B in the event the load is dropped or the cables break. This feature is described in detail in U.S. Pat. No. 4,370,367 issued to the present inventor on Dec. 6, 1994 for a "Safety Device for an Air Balancing Hoist".

In operation, when regulated air pressure is introduced into chamber 20A, any resulting axial shifting movement of the cable drum 26A is also undergone by the slave hoist cable drum 26B by the action of rods 54, so that each cable 42A, 42B is wound or unwound at exactly the same rate, regardless of the weight distribution between these cables. Thus, the load item 44 is maintained in any desired initial attitude with respect to the horizontal.

Figure 3:
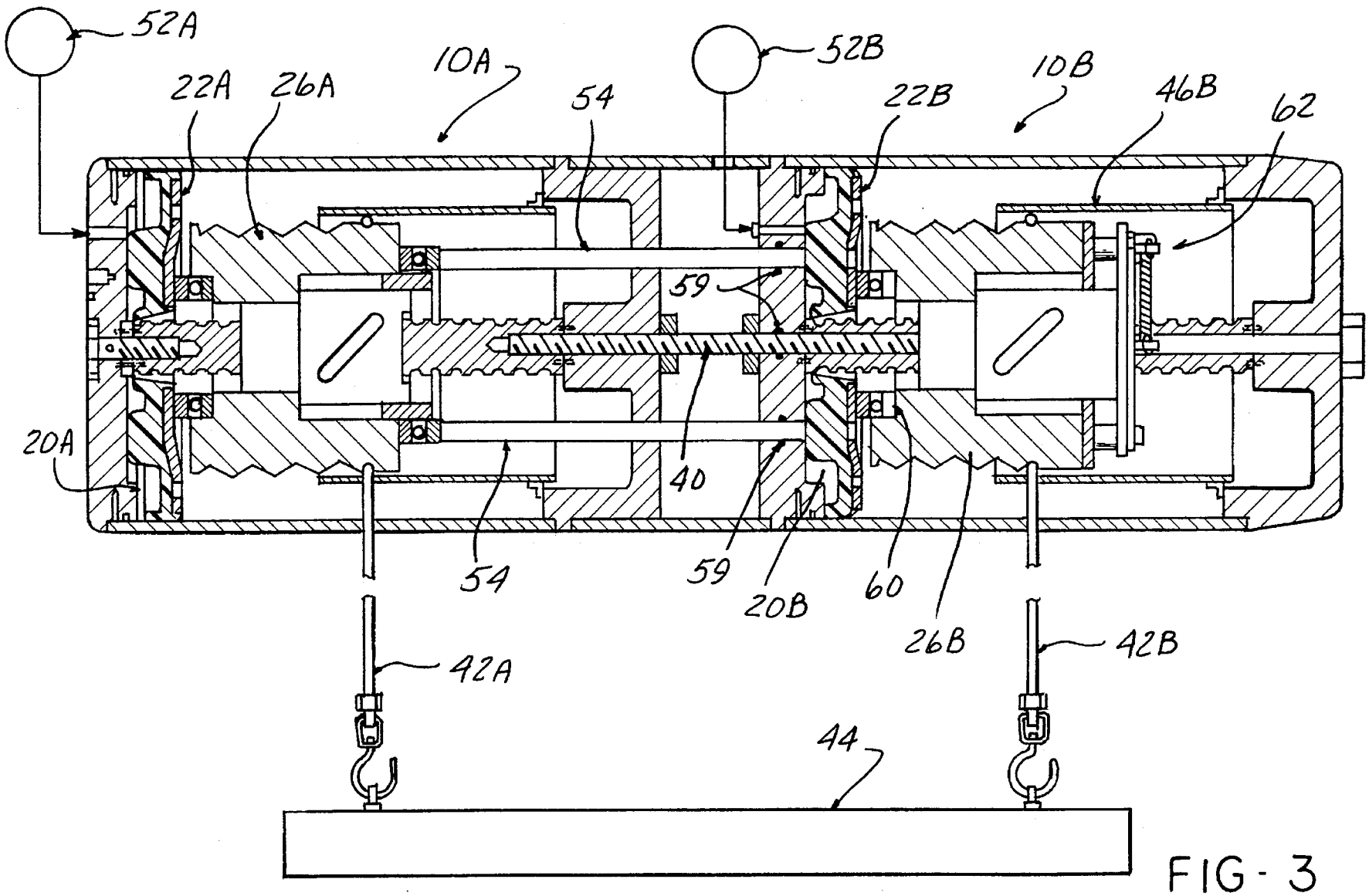
FIG. 3 is a longitudinal sectional view of a pair of hoists connected together according to a second embodiment of the combination hoists according to the present invention, showing a supported load item and a schematic representation of associated air pressure controllers.

FIG. 3 shows an alternate embodiment, in which a slave hoist piston 22B and air chamber 20B are added. Seals 59 for the rod 54 and threaded shaft 40 are provided. In this instance, a second air pressure controller 52B is added, with the air pressure set to be in a lower range than the pressure of the air applied in master chamber 20A. Piston 22B engages the end of cable drum 26B via a second thrust bearing 60. However, the force transmitting rods 54 engage the piston 22B to apply the force of piston 22A to the cable drum 26B.

The lower pressure applied in chamber 20B must be set at a level which generates a force which cannot by itself overcome the weight held by the cable 42B.

However, this force will still act to assist the force exerted by engagement of the rods 54, applying the force generated by the higher pressure applied to the master hoist piston 22A. Thus, the cable drums 26A and 26B will be sure to move together, but both pistons 22A, 22B contribute in generating the weight counterbalancing force. This reduces the pressure level required and the force levels necessary to be exerted by the master hoist components.

This embodiment also incorporates another form of safety device, as described in copending U.S. patent application Ser. No. 08/284,800 filed on Aug. 2, 1994 by the present inventor.

Figure 4:
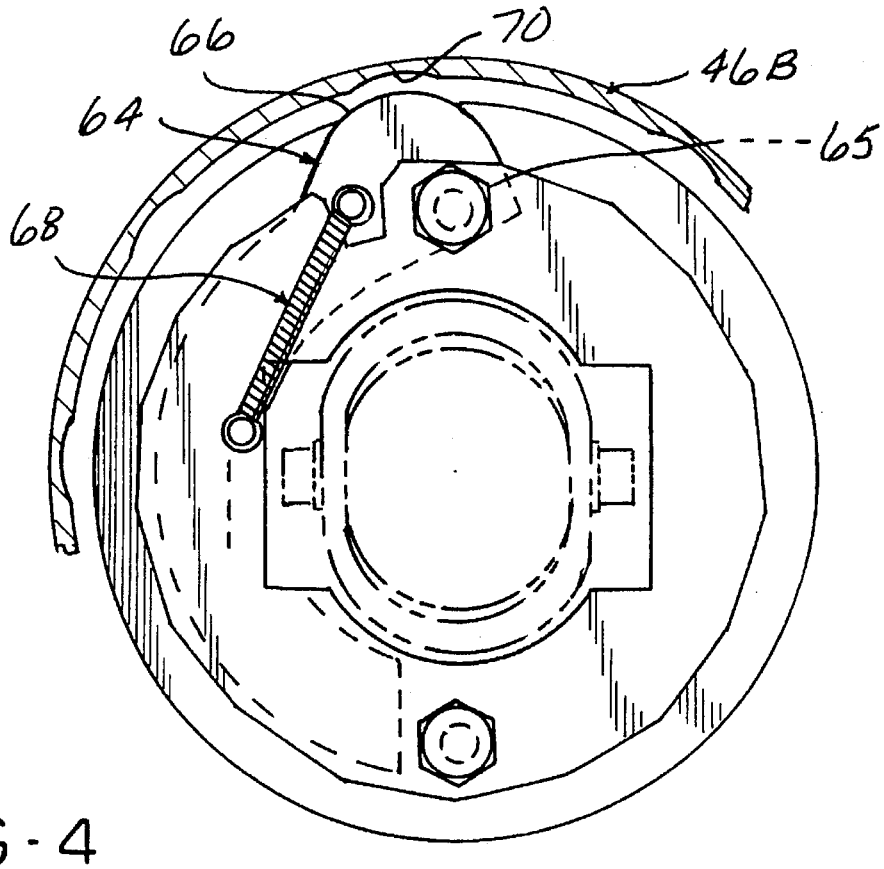
FIG. 4 is a fragmentary view of a transverse section taken through the slave hoist, illustrating the safety device associated therewith in an inactivated condition.
Figure 5:
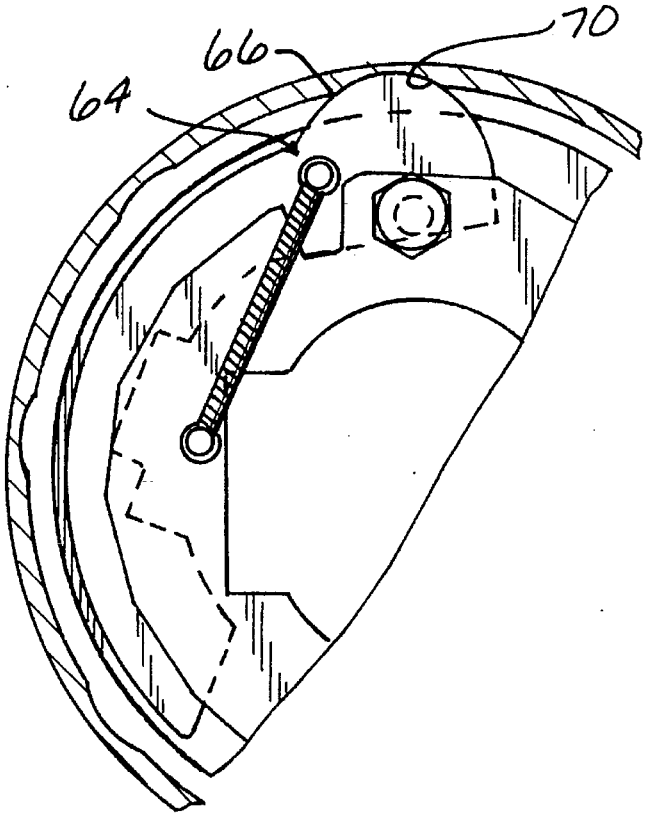
FIG. 5 is the fragmentary sectional view of FIG. 4 but with the safety device activated.

This device as shown in FIGS. 4 and 5 includes a self energizing centrifugal brake assembly 62 mounted to the right end of the cable drum 26B, in which a brake element 64 pivoted about bolt 65 has a radiused end 66 when the cable drum 26B rotates at an excessive speed indicating a runaway condition.

The radiused surface 66 engages a scalloped inner surface 70 of a cable reel 46B.

Figure 7:
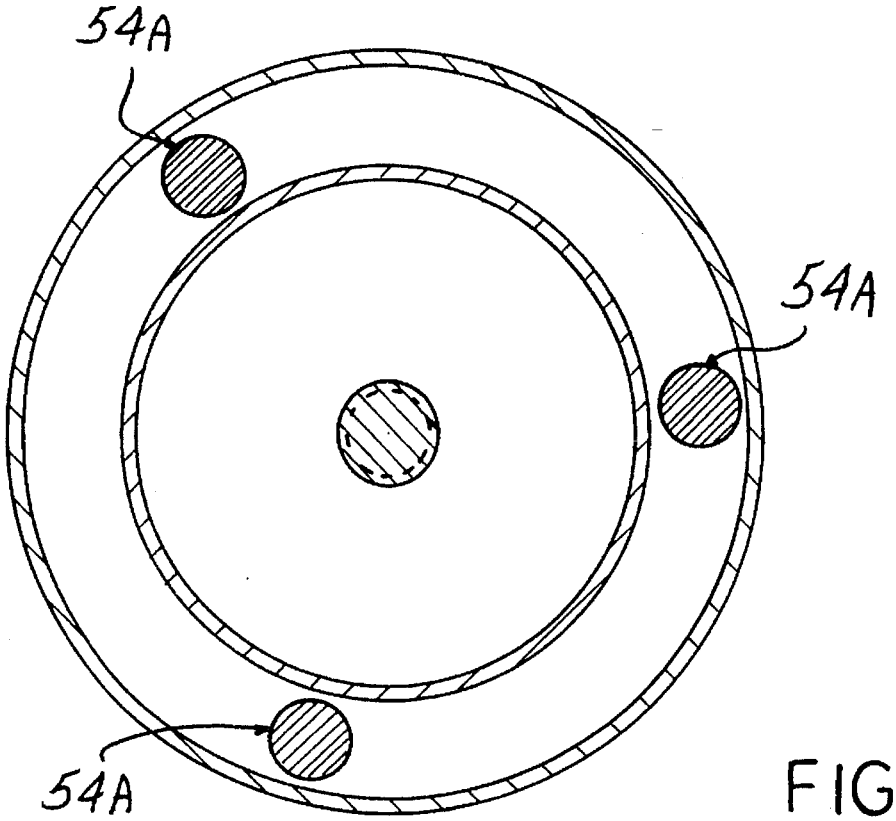
FIG. 7 is a transverse sectional view taken through the hoist combination shown in FIG. 6.
Figure 6:
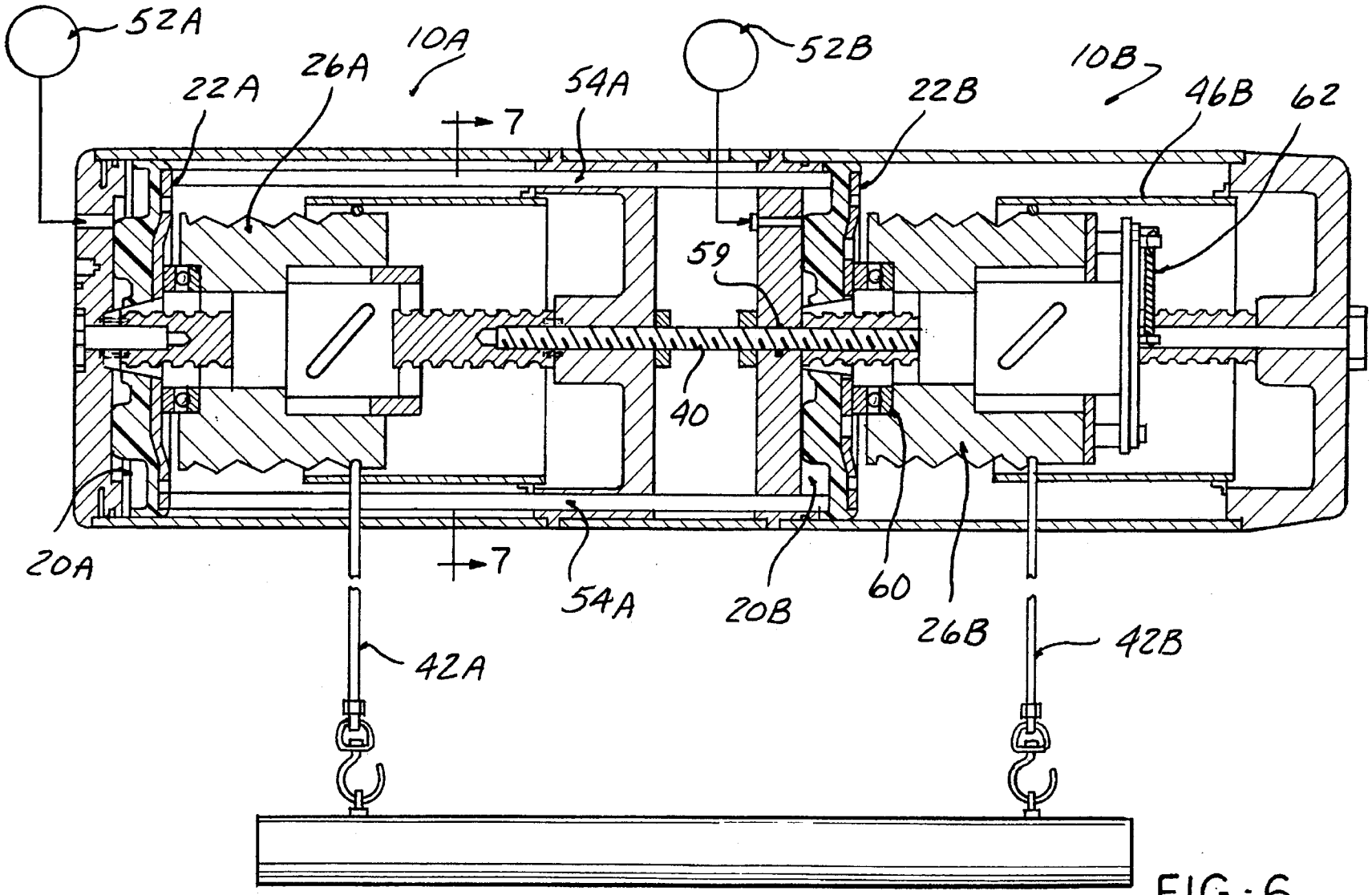
FIG. 6 is a longitudinal sectional view of a third embodiment of the present invention.

In a third preferred embodiment shown in FIGS. 6 and 7, three force transmission rods 54A are employed, which are equally spaced apart circumferentially. The force transmission rods directly interengage the respective pistons 22A, 22B of the two hoists 10A, 10B to create slaved axial movement and synchronous rotation of the winding drum 26A, 26B. Thus, the need for thrust bearings is eliminated, since the pistons 22A, 22B do not rotate as contrasted with the winding drums 26A, 26B.

The use of three rods 54A insures that the two pistons 22A, 22B are maintained parallel to each other, avoiding any tipping which could cause wedging of the pistons.

I claim:

1. A fluid pressure balancing hoist combination, comprising: a master air balancing hoist including a housing, a fluid pressure chamber defined in said housing and a piston axially movable in said housing and defining in part said fluid pressure chamber so that said fluid pressure in said chamber is exerted thereon, a cable drum mounted in said housing for rotation and axial movement in said housing and having a load cable fixed thereto and adapted to be wound thereon and unwound therefrom by rotation of said cable drum either direction, said piston engaging one end of said cable drum to urge axial movement thereof in a first direction;

means causing said cable drum to rotate to wind said cable thereon upon movement axially in said first direction;

a slave balancing hoist including a housing, a cable drum mounted in said housing for rotation and axial movement in said housing, a cable fixed thereto and adapted to be wound thereon and unwound therefrom upon rotation of said cable drum in either direction;

means causing said slave hoist cable drum to rotate when moved axially in said first direction; and, force transmitting means acting between said hoists causing said master hoist cable drum and said slave hoist cable drum to axially move with each other when said master hoist cable drum moves axially in said first direction, whereby said master hoist and slave hoist cable drums rotate to wind or unwind their respective cables in synchronism with each other.

2. The hoist combination of claim 1 wherein said force transmitting means includes an axially movable force transmitting rod having opposite ends, one end drivingly engaged with said master hoist cable drum and another end engaged with said slave hoist cable drum, whereby axial movement of said slave hoist cable drum in said first direction is transmitted to said slave hoist cable drum.

3. The hoist combination of claim 2 including a second axially extending force transmitting rod located diametrically opposite said first mentioned force transmitting rod.

4. The hoist combination of claim 2 wherein said housing of said master and slave hoists are connected together end-to-end, and said force transmitting rod extends through adjacent portions of said housings to be rotationally fixed.

5. The hoist combination of claim 4 wherein said housings are spaced apart by a spacer section, and each of said housings and said spacer section are secured together into a unitary structure.

6. The hoist combination of claim 4 wherein said means causing rotation of said cable drums upon axial movement thereof includes a ball screw mechanism.

7. The hoist combination of claim 2 further including a fluid pressure chamber in said housing of said slave hoist and a piston axially movable in said housing and defining in part said fluid pressure chamber, and means exerting a fluid pressure on said piston of a pressure less than said fluid pressure exerted on said master hoist piston, said piston drivingly engaged with said slave hoist cable drum.

8. The hoist combination of claim 7 wherein said force transmitting rod engages said slave hoist piston to drivingly engage said master hoist cable drum and said slave hoist cable drum.

9. The hoist combination of claim 1 wherein said force transmitting means comprises a plurality of elongated rods, each rod having either end axially drivingly engaged with a respective hoist piston.

10. The hoist combination of claim 9 wherein said force transmitting means comprises three rods equally spaced circumferentially.

* * * * *